United States Patent [19]

Snyder et al.

[11] 4,294,408

[45] Oct. 13, 1981

[54] IN CENTRIFUGAL SPRAY GUNS

[75] Inventors: Irving F. Snyder; Duane A. Luebeck, both of Blaine, Minn.

[73] Assignee: Graco Inc., Minneapolis, Minn.

[21] Appl. No.: 148,135

[22] Filed: May 8, 1980

[51] Int. Cl.[3] ..... B05B 3/08

[52] U.S. Cl. ..... 239/218.5

[58] Field of Search ..... 239/214, 215, 218.5, 239/222, 222.11, 223, 224, 332; 198/670

[56] References Cited

U.S. PATENT DOCUMENTS 1,877,350 9/1932 Meachem ..... 239/218.5

2,023,710 12/1935 St. Onge ..... 239/218.5

3,455,507 7/1969 Ryder et al. ..... 239/218.5 X

*Primary Examiner*—Andres Kashnikow

*Attorney, Agent, or Firm*—Paul L. Sjoquist

[57] ABSTRACT

A paint spraying apparatus of the type utilizing a high speed rotating disk having a liquid feed mechanism to the underside of the disk, wherein the improvement includes a metering valve which forms an extension of the rotating sprayer portion and is intermediate the spraying disk and a screw-driven pump, wherein the valve may be axially positioned into a valve seat for controlling liquid flow rate.

11 Claims, 4 Drawing Figures

IN CENTRIFUGAL SPRAY GUNS

BACKGROUND OF THE INVENTION

This invention relates to liquid spraying devices, and more particularly to paint spraying devices of the type utilizing centrifugal atomization of paint by feeding paint to a disk rotating at high speed, and thereby centrifugally distributing paint droplets off the spinning edge of the disk and onto the article to be painted.

Centrifugal sprayers are well-known in the prior art in general, and have been used in the art of paint spraying for at least about fifty years. For example, U.S. Pat. No. 2,023,710, issued Dec. 10, 1935, disclosed a centrifugal paint sprayer having a screw feed mechanism for pumping paint through an axially positioned tube, and through a passage in such tube which is controllable by a sliding gate, to a feed orifice for discharging the paint against the under-surface of a spinning disk. U.S. Pat. No. 2,251,457, issued Aug. 5, 1941, discloses a centrifugal paint sprayer having a hollow motor shaft and axial centrifugal pumping means for raising paint from a container into a spinning disk, the amount of paint being applied being controlled by an adjustable external gate which permits more or less paint emitted from the spinning disk to escape through a V-shaped gate orifice. All paint centrifugally released from the spinning disk which does not escape through the V-shaped opening is drained back into the paint container.

Almquist U.S. Pat. No. 2,749,179, issued June 5, 1956, discloses a motor-driven disk paint gun having two disks for creating an air suction to the paint receptacle. A relief passage intersects the suction passage and is coupled to the atmosphere via a hole in the gun handle, so the operator can place a finger over the hole to selectively draw paint to the disk. Kanarek U.S. Pat. No. 3,074,650, issued Jan. 22, 1963, discloses a motor-driven centrifugal disk paint gun having a screw pump paint feeding mechanism. Paint flow throught the pumping mechanism and hence to the spinning disk is controlled by a flat valve plate which is positioned at the bottom end of the screw pump, and adjustment means is provided for varying the orifice opening between the valve plate and the screw pump inlet.

U.S. Pat. No. 3,125,296, issued Mar. 17, 1964, discloses a motor-driven centrifugal disk paint sprayer having a screw pump paint feeding mechanism and a sliding gate valve metering control which controls paint flow rate by varying the opening into the pump inlet. U.S. Pat. No. 3,455,507, issued July 15, 1969 discloses a motor driven centrifugal disk paint sprayer having a screw pump and a controllable orifice between the underside of the spinning disk surface and the pump outlet tube, whereby the adjustment of this orifice permits regulation of paint flow rate.

All of the foregoing prior art patents utilize some form of paint flow rate regulation, either at the inlet of the paint pumping mechanism, or intermediate the pumping mechanism and the disk, or at the outlet of the pumping mechanism as it opens to the spinning disk surface. The present invention is an improvement in paint metering of centrifugal disk paint sprayers of the type generally disclosed in the foregoing patents, providing an efficient and economical metering mechanism for controlling paint flow rate; and providing for an accurate flow rate control.

SUMMARY OF THE INVENTION

The invention includes an improved flow rate metering control in conjunction with a screw pump for regulating the volume flow rate of paint to the underside of a spinning disk in a centrifugal paint sprayer. A rotatable screw pump in a fixed tube has a conical valve member formed as a part thereof, the conical valve member being seated in rotatable and axially adjustable position against the upper end of the fixed tube. A rotatably fixed, but axially slidable housing surrounds the tube and metering valve assembly and projects upwardly to a predetermined fixed distance from the undersurface of the disk. The disk is axially slidable with the metering valve and the housing to provide a fixed annular flow opening between the top of the housing and the undersurface of the disk, while permitting a variable annular flow opening between the metering valve and the fixed tube surrounding the screw pump.

It is therefore a principal object of the invention to provide an adjustable metering valve for regulating paint flow in a centrifugal paint sprayer, while providing a fixed annular orifice between the undersurface of the disk and the paint feed mechanism.

It is another object of the invention to provide a paint metering valve assembly which is a part of the paint feed mechanism, and which will readily compensate for dimensional design tolerances.

It is a further object of the present invention to provide a paint feeding and flow control mechanism which may be readily disassembled for cleaning.

It is another object of the invention to provide a paint feeding and flow regulating mechanism for a centrifugal paint sprayer which may be constructed from low cost components, preferably of plastic construction.

BRIEF DESCRIPTION OF THE DRAWINGS

The foregoing and other objects of the invention will become apparent from the following specification, and with reference to the appended drawings, in which.

DESCRIPTION OF THE PREFERRED EMBODIMENT

Figure 1:
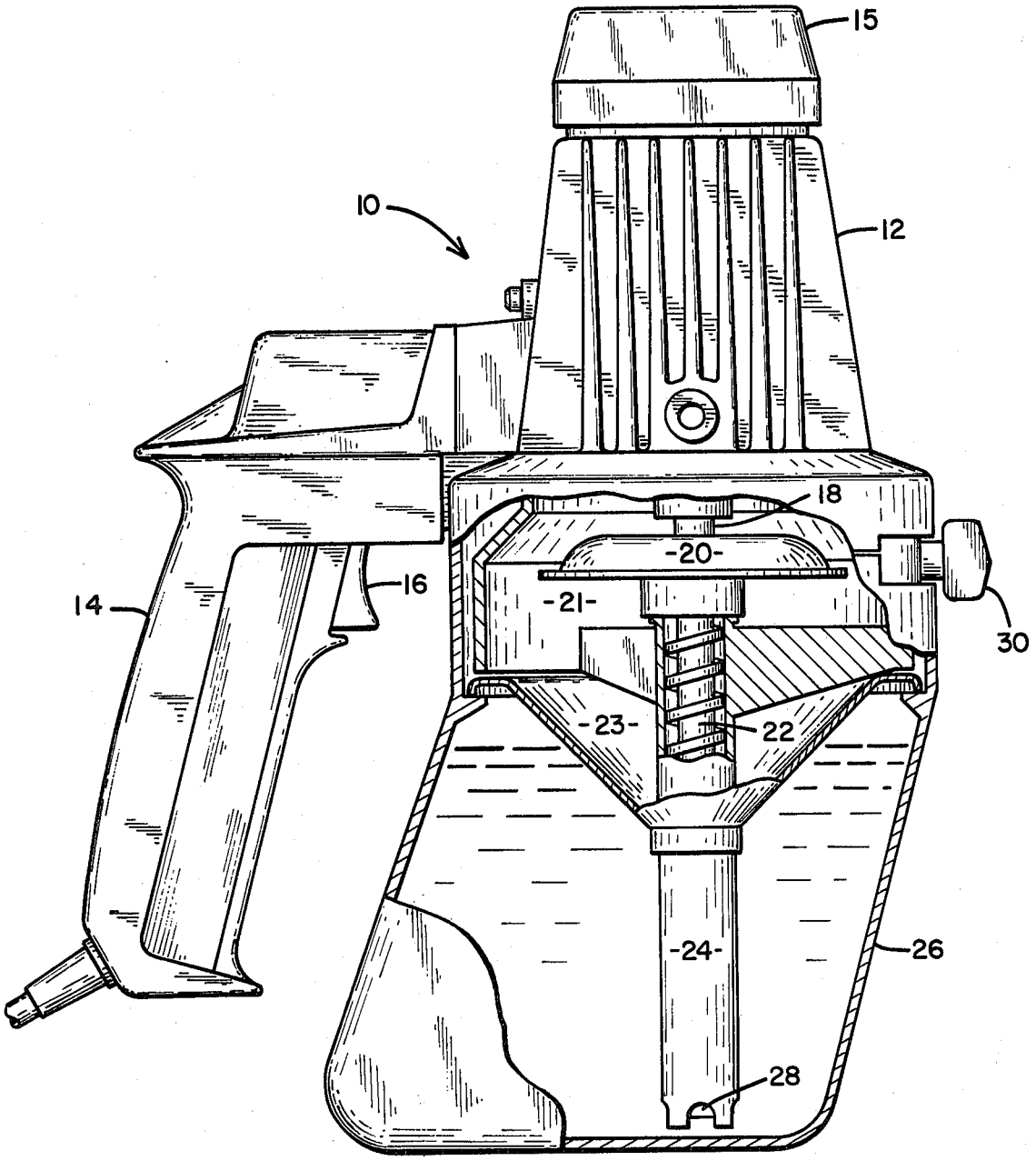
FIG. 1 is an elevational view in partial cross-section of a spray gun of the present invention.

Referring first to FIG. 1, there is shown in side elevational view and partial cross-section a centrifugal paint sprayer 10. Paint sprayer 10 has a motor housing 12 which encloses an electric motor capable of developing rotational speeds on the order of 10,000–20,000 RPM. The paint sprayer is held by handle 14, and the electric motor is activated by trigger 16. A motor shaft 18 projects downwardly from the motor within motor housing 12 and has a disk 20 attached thereto. A screw pump 22 is attached to motor shaft 18, so that when trigger 16 is actuated motor shaft 18, disk 20 and screw pump 22 all rotate at a very high rate of speed. A feed tube 24 encloses screw pump 22 and projects downwardly into paint reservoir 26. Paint contained within reservoir 26 may enter feed tube 24 through an inlet 28 at the bottom thereof, the paint being conveyed upwardly through feed tube 24 by means of screw pump 22. Paint thus conveyed is distributed to the undersurface of disk 20, and the rapid rotation of disk 20 causes this paint to become centrifugally distributed and dispersed off the outer edge of the disk. Most of the paint so dispersed is hurled onto paint guard 21 and falls back into reservoir 26 through the lower openings in shield 23. Some of the centrifugally dispersed paint from disk 20 is permitted to leave the spray apparatus through a variable opening which is controlled by a sliding gate 30. Sliding gate 30 may be adjustably positioned to permit a wider or narrower pattern of spray particles to be emitted from the paint sprayer 10.

Figure 2:
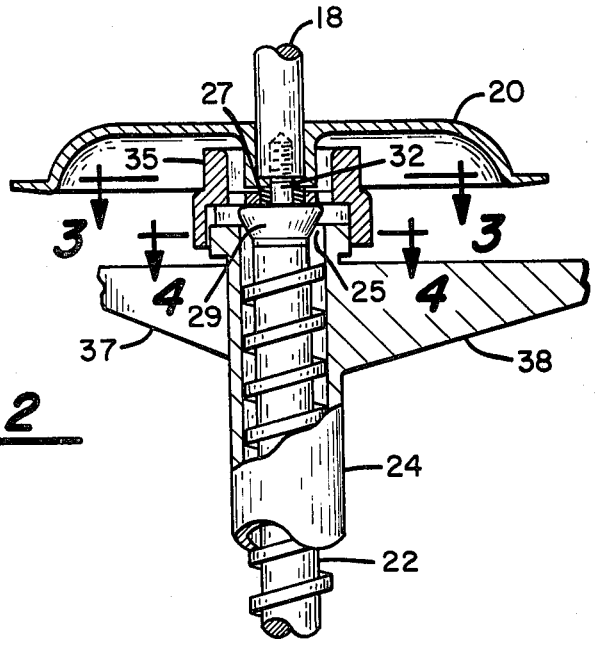
FIG. 2 is an expanded side cross-sectional view of a portion of the spray gun of FIG. 1.

The volume of paint flow which is conveyed to the undersurface of disk 20 is proportional to the volume of paint dispersed by paint sprayer 10. FIG. 2 shows the paint flow metering mechanism which regulates this volume. Feed tube 24 terminates in an opening 25, which opening may be either cylindrical or flanged. The end of screw pump 22 is formed into a conical valve member 29, sized so as to seat within opening 25 of feed tube 24. A cylindrical shoulder 27 projects above valve member 29 in axial alignment therewith. A threaded stud 32 projects from the end of the assembly consisting of shoulder 27, valve 29 and screw pump 22, and is threadably fastened into the end of motor shaft 18. Screw pump 22, valve member 29 and shoulder 27 are preferably made from moulded plastic, and stud 32 is preferably affixed into the end of these members during the moulding process.

Figure 3:
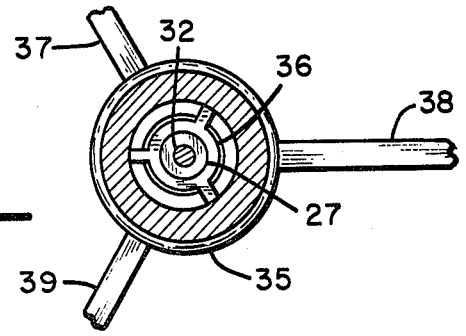
FIG. 3 is a top view taken along the lines 3—3 of FIG. 2.

FIG. 3 shows a top view taken along the lines 3—3 of FIG. 2, wherein housing 35 is shown axially positioned relative to shoulder 27 and stud 32. Housing 35 has radially inwardly projecting struts securing it to a collar 36 which is loosely fitted over shoulder 27, so as to permit shoulder 27 and its related components to freely rotate there within.

Figure 4:
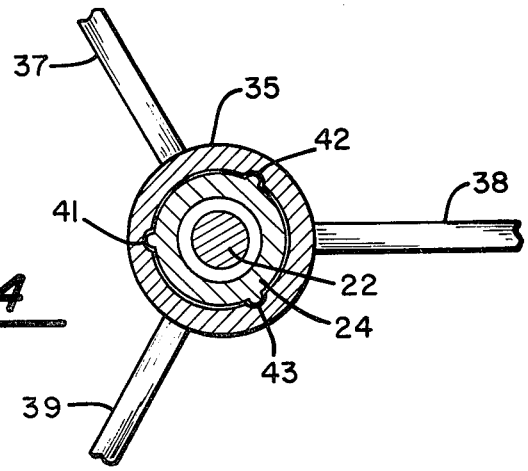
FIG. 4 is a top view taken along the lines 4—4 of FIG. 2.

FIG. 4 shows a top view taken along the lines 4—4 of FIG. 2. Housing 35 surrounds feed tube 24 which is affixed to paint guard 21 by means of supports 37, 38, 39. Housing 35 is slidable upwardly and downwardly over the outside circumference of feed tube 24, but is prevented from rotating relative to feed tube 24 by ribs 41, 42, 43 which form a part of the exterior surface of feed tube 24. Ribs 41, 42, 43 are slidably mated to complementary shaped grooves along the interior surface of housing 35.

It should be noted that the height of shoulder 27 is made slightly greater than the thickness of collar 36, so as to permit shoulder 27 to be tightened against the formed underside of disk 20 and to clamp disk 20 securely against motor shaft 18, without clamping collar 36. It is essential that collar 36 be relatively loosely fitted about shoulder 27 so as to permit the shoulder and its associated rotating parts to freely turn within collar 36 without imparting rotational torque against collar 36. It has been found that a height clearance of shoulder 27 above collar 36 of from 0.004–0.010 inches is sufficient to provide the necessary clearance, and a radial clearance of 0.004–0.015 inches between shoulder 27 and collar 36 is sufficient to provide the necessary radial clearance for free relative rotation without excessive fluid leakage.

Shoulder 27 may be formed in the same molding process as screw 22 and valve 29 as an extension thereof, or it may be formed as a shoulder of stud 32.

In operation, the metering orifice determined by the annular clearance of valve member 29 from the end of feed tube 24 is controlled by axially adjusting the entire assembly including screw pump 22, valve member 29, housing 35, disk 20, and motor shaft 18. This adjustment is made by rotating metering knob 15, which is attached to the motor within motor housing 12 to cause such axial positioning. The attachment of metering knob 15 to the motor may be made by threaded coupling or other conventional means, it merely being sufficient to cause a slight axial movement of the motor by rotation of knob 15. In practice it has been found that an axial adjustment of 0–0.050 inches is sufficient to cause a normal range of paint flow control. When knob 15 is rotated through a predetermined angular setting valve member 29 is caused to displace a predetermined amount from its seat against the end of feed tube 24. Housing 35 and disk 20 move by an amount corresponding to valve member 29, thereby maintaining a fixed and constant flow orifice between the undersurface of disk 20 and the top edge of housing 35. The paint which flows through the annular orifice between valve member 29 and feed tube 24 flow upwardly over the top edge of housing 35 and is frictionally conveyed to the undersurface of the rapidly spinning disk 20. Because of centrifugal motion the paint disperses and feeds outwardly over the undersurface of disk 20 and is hurled free in very small droplets from the outer circumference of disk 20. As has been previously described, a portion of these paint droplets are emitted from paint sprayer 10 through gate 30 in atomized form and may be applied to an article or surface to be coated.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for spraying liquid by centrifugal atomization of liquid pumped from a container to the surface of a high speed spinning disk, comprising (a) a drive motor mounted on a vertical axis and having a downwardly projecting motor shaft;

(b) a circular disk and helical screw pump attached to said motor shaft in axial alignment, the upper end of said screw pump forming a frusto conical valve member;

(c) a hollow tube surrounding said screw pump and extending into said container, said tube having a telescoping upper portion and a lower portion which is seatable against said valve member;

(d) means for axially fixing said tube upper portion relative to said disk; and (e) means for axially varying said disk, said tube upper portion and said valve member relative to said tube lower portion.

2. The apparatus of claim 1, wherein said means for axially fixing said tube upper portion further comprises a collar encircling said screw pump upper end.

3. The apparatus of claim 2, further comprising a circular shoulder on said screw pump upper end, about which spacer said collar is loosely fitted.

4. The apparatus of claim 3 further comprising means for restricting rotation of said tube upper portion about said tube lower portion.

5. The apparatus of claim 3, further comprising a threaded coupling between said motor shaft and said screw pump upper end.

6. The apparatus of claim 4, wherein said means for restricting rotation further comprises at least one rib and complementary shaped groove in respective surfaces of said tube upper and lower portion.

7. In an apparatus for spraying by centrifugal deposition of liquid droplets from a high speed spinning disk, the improvement in metering liquid flow from a reservoir to the disk, comprising (a) a fixed hollow tube having a lower end in said reservoir and an upper end opening toward said disk;

(b) a helical screw pump in said tube, said screw pump having an end extending above the tube upper end opening;

(c) a valve member on said pump end, said valve member being seatable against said tube upper end opening;

(d) a cylindrical housing axially slidable over said tube and having an upper edge above said valve member;

(e) a disk having its undersurface positioned a predetermined distance from the upper edge of said housing;

(f) means for rotating said disk and said screw pump; and (g) means for axially positioning said disk, said housing; said valve member and said screw pump relative to said tube.

8. The improvement of claim 7, wherein said housing and said tube further comprise ribs and complementary shaped grooves for permitting axial movement while preventing rotational movement of said housing.

9. The apparatus of claim 8, further comprising a raised cylindrical shoulder axially adjacent said valve member and fixedly positioned against said disk.

10. The apparatus of claim 9, wherein said cylindrical housing further comprises an inner collar concentrically located on the inside of said housing, said collar loosely fitted about said raised shoulder.

11. The apparatus of claim 10, further comprising a plurality of radial struts attaching said collar in concentric position in said housing.

* * * * *

UNITED STATES PATENT AND TRADEMARK OFFICE

CERTIFICATE OF CORRECTION

PATENT NO. : 4,294,408

DATED : October 13, 1981

INVENTOR(S) : Irving Florian Snyder
Duane Alfred Luebeck

It is certified that error appears in the above-identified patent and that said Letters Patent are hereby corrected as shown below:

Please change the title of this patent from:

IN CENTRIFUGAL SPRAY GUNS to:

CENTRIFUGAL SPRAY GUN

Signed and Sealed this

*Fifteenth* Day of *June 1982*

[SEAL]

*Attest:*

GERALD J. MOSSINGHOFF

*Attesting Officer*

*Commissioner of Patents and Trademarks*